US005261785A

United States Patent [19]

Williams

[11] Patent Number: 5,261,785

[45] Date of Patent: Nov. 16, 1993

[54] ROTOR BLADE COVER ADAPTED TO FACILITATE MOISTURE REMOVAL

[75] Inventor: John C. Williams, Schenectady, N.Y.

[73] Assignee: General Electric Company, Schenectady, N.Y.

[21] Appl. No.: 924,509

[22] Filed: Aug. 4, 1992

[51] Int. Cl.[5] ..... F01D 25/32

[52] U.S. Cl. ..... 415/169.2; 415/169.3; 415/169.4; 416/191

[58] Field of Search ..... 415/169.1, 169.2, 169.3, 415/169.4; 416/191

[56] References Cited

U.S. PATENT DOCUMENTS

| | | | |
|---|---|---|---|
| 1,349,886 | 8/1920 | Junggren | 415/169.4 |
| 3,290,004 | 12/1966 | Ishibashi | 415/169.4 |
| 3,304,056 | 2/1967 | Sohma | 253/76 |
| 3,751,182 | 8/1973 | Brown | 416/191 |
| 4,195,396 | 4/1980 | Blazek | 29/156.8 |
| 4,257,742 | 3/1981 | Ogata et al. | 416/190 |
| 4,400,915 | 8/1983 | Arrigoni | 51/217 R |
| 4,688,992 | 8/1987 | Kirkpatrick | 416/215 |
| 4,710,102 | 12/1987 | Ortolano | 416/190 |

FOREIGN PATENT DOCUMENTS

| | | | |
|---|---|---|---|
| 164297 | 12/1933 | Switzerland | 415/169.2 |
| 235774 | 1/1969 | U.S.S.R. | 415/169.4 |
| 375392 | 3/1973 | U.S.S.R. | 415/169.4 |
| 510583 | 4/1976 | U.S.S.R. | 415/169.4 |

*Primary Examiner*—John T. Kwon
*Attorney, Agent, or Firm*—Nixon & Vanderhye

[57] ABSTRACT

In a steam turbine cover (18) for an axial flow steam turbine including a rotor (14), an annular row of radially extending blades (12) carried by the rotor, each blade having a leading edge (150 or 250), a trailing edge and a radial tip, at least one moisture removal groove (146 or 246) extending radially along the blade adjacent the leading edge (150 or 250), and an annular cover assembly coupling the radial tips of the annular row of blades, there is provided a plurality of circumferentially spaced, axially extending notches (158, 160 or 260) formed in the annular entrance edge (134 or 234) of the cover assembly, one notch for each blade, the notch radially exposing the leading edge and moisture removal groove of each such blade.

16 Claims, 3 Drawing Sheets

ROTOR BLADE COVER ADAPTED TO FACILITATE MOISTURE REMOVAL

TECHNICAL FIELD

This invention relates to steam turbines and, more specifically, to a new steam turbine shroud or cover design devised to permit removal of moisture in the steam without significant change in the bucket and/or cover design.

BACKGROUND ART

In the latter stages of steam turbines, the moisture content can increase to a level which degrades thermal efficiency and increases water impact erosion of the latter stage buckets. One approach for removing this moisture is to groove the leading edges of the buckets (or blades) to capture the water, and to use centrifugal force generated by the rotating turbine rotor to throw the water out to stationary moisture collection devices. With this approach, the entrance edge of the annular tip cover or shroud extending over the leading edges of the buckets must be severely cut back (i.e., axially shortened by reducing the width of the cover) to allow the water to be thrown out to the stationary moisture collection devices without interference from the cover.

A radical cut back of the cover can, however, significantly affect the bucket design and associated vibration frequencies, and in some cases, requires separate bucket designs with and without a moisture removal capability. The radical cut back of the cover also eliminates or at least degrades sealing at the entrance edge of the cover, thereby reducing the stage thermal efficiency. Another disadvantage is the requirement for the design of a new tenon (and vane tip build-up for the new tenon) on the blade tip for receiving individual segments of the cover.

DISCLOSURE OF INVENTION

This invention relates to a new and unique steam turbine shroud or cover devised to permit removal of moisture in the steam without a significant change in the bucket and cover design. To this end, the entrance edge of the cover is relieved at circumferentially spaced locations where the cover or shroud extends over the leading edges of the buckets, to thereby radially expose the leading edges so as to permit moisture to be thrown out to moisture collection devices which drain the water out of the turbine without any radial interference from the cover.

More specifically, a turbine cover in accordance with an exemplary embodiment of this invention maintains the normal cover width, i.e., the normal width for covers in non-moisture removal applications, which is equal to or greater than the effective width dimension of the blades, throughout a substantial portion of the circumference of the cover. Only in those areas where the entrance edge of the cover would normally overlie the leading edge moisture removal grooves of each bucket is the width reduced by providing a notch or scalloped area to radially expose the moisture removal grooves. In other words, with the exception of the scalloped areas, the cover and associated blade/cover tenon as well as the blade vane tip are essentially the same with or without the moisture removal feature. Accordingly, the same bucket design can be used with or without moisture removal, with no significant impact on stage efficiency so long as the scalloped areas do not significantly affect bucket vibration frequencies.

The turbine cover scalloped areas in accordance with this invention may increase bucket frequencies due to the removal of cover mass, but at the same time may decrease bucket frequencies due to the accompanying reduction in cover stiffness. Thus, the providing of scalloped areas for different buckets will have different effects on their respective frequencies. However, the scalloped area design as disclosed herein can be varied to balance and thereby minimize the effect on the critical bucket frequencies, as will be appreciated by those skilled in the art.

The above described scalloped areas can be employed for moisture removal with peened-on covers, but also may be applied to covers which are integral with individual buckets. In other words, for integral bucket/cover applications, the same design characteristics apply with the exception of the effects on bucket frequency. With separate and integral covers for each bucket, the scalloped area design will tend only to increase bucket frequencies due to the removal of cover mass, but since there is no significant effect on the stiffness of the connection, there will be no associated decrease in bucket frequencies.

In accordance with an exemplary embodiment of the invention, there is provided in an axial flow steam turbine including a rotor and an annular row of radially extending blades carried by the rotor, each blade having a leading edge, a trailing edge and a radial tip, and at least one moisture removal groove extending radially along the blade adjacent the leading edge, and an annular cover assembly coupling said radial tips of said annular row of blades, the cover assembly having an annular entrance edge; the improvement comprising: a plurality of axially extending notches formed in the annular entrance edge of the cover assembly, one notch provided for each blade and radially exposing the leading edge and moisture removal groove of each such blade.

In another aspect, the invention provides a steam turbine cover for an axial flow steam turbine including a rotor and an annular row of radially extending blades carried by the rotor, each blade having a leading edge and trailing edge, the cover comprising: an annular strip including one or more curved sections attachable to radially outer edges of the blades, the annular strip having a width dimension sufficient to cover the leading and trailing tips of the annular row of blades, the annular strip having a forward sealing edge closest the leading edges of the rotor blades and a rearward edge closest the trailing edges of the rotor blades, the forward sealing edge including relieved areas at circumferentially spaced locations to radially expose the leading edges of each of the blades.

Thus, the turbine cover design in accordance with this invention minimizes the loss in forward cover edge blade tip sealing so that there is no degradation of stage efficiency, and at the same time permits the same bucket/cover assembly to be used in turbines with or without moisture removal capability. For bucket designs with peened-on covers, the present invention also allows the use of the existing bucket tenon and vane tip build-up design.

Other objects and advantages of the present invention will become apparent from the detailed description which follows.

BEST MODE FOR CARRYING OUT THE INVENTION

Figure 1:
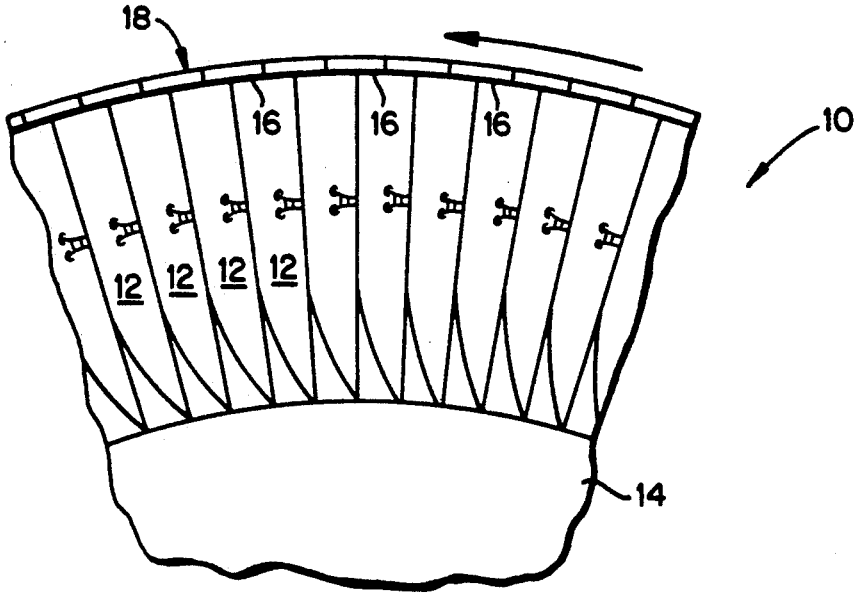
FIG. 1 (PRIOR ART)
FIG. 1 is a partial end view of a conventional rotor and bucket assembly.
Figure 2:
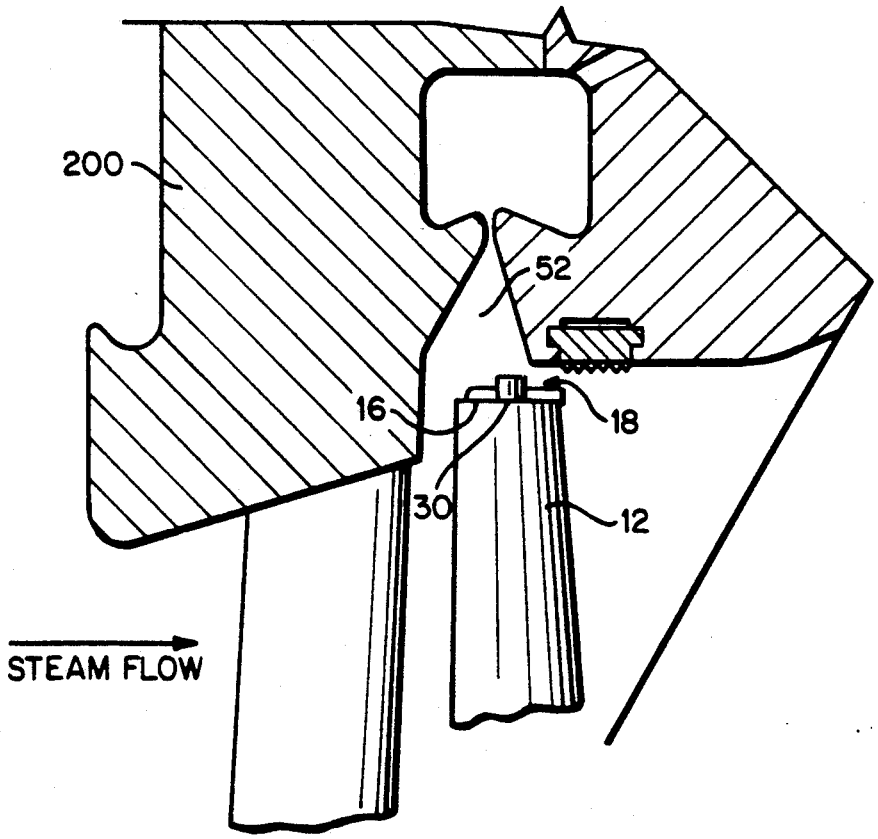
FIG. 2 (PRIOR ART)
FIG. 2 is a partial side view illustrating an individual bucket and radial tip seal assembly incorporating moisture removal in a known construction.

With reference to FIGS. 1 and 2, a typical turbine stage 10 is partially shown with a plurality of buckets or blades 12 secured to a turbine rotor 14 by conventional means, for example, sliding dovetail joints. The radial tip portions 16 of the buckets 12 are connected by an annular tip cover or shroud 18.

Figure 3:
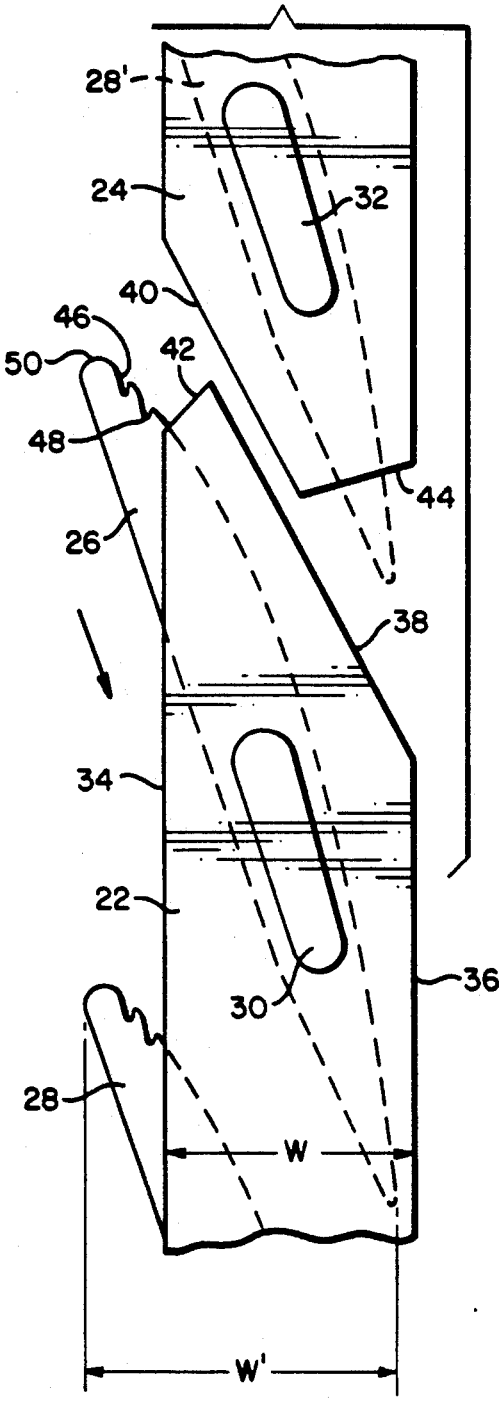
FIG. 3 (PRIOR ART)
FIG. 3 is a partial radial view of a bucket tip and peened-on cover in accordance with a conventional bucket/cover assembly incorporating moisture removal capability.

With reference now to FIGS. 2 and 3, the bucket shroud or cover 18 may include a number of circumferential segments, two of which are shown at 22, 24, and each of which may be attached to a pair of blades. As shown in FIG. 3, segment 22 is attached to blade 26 by means of a tenon 30. A second blade 28 is also attached to the segment 22. As shown, the trailing section of the blade 28 will be similar to the trailing section of the blade 28' underlying segment 24. Hence, the tenon 32 shown connecting segment 24 to blade 28' illustrates how a tenon (not shown) connects blade 28 to segment 22. The segments 22, 24, etc. extend about the entire circumference of the bucket or blade assembly, but only a few such segments need be shown here for purposes of this invention. Each segment includes an entrance or forward sealing edge 34, a rearward edge 36 extending parallel to the forward edge, and substantially parallel lateral or transverse edges 38 and 40 which are cut at an angle relative to the rotor axis so as to be complementary to each other. The terms "forward", "rearward" and "leading" as used here have reference to the direction of steam flow which travels in a forward to rearward direction, over the leading then trailing bucket edges as indicated by the flow arrows in FIGS. 2 through 5. The transverse edges also have beveled or truncated forward and rearward portions 42, 44, respectively.

Each turbine blade 26, 28 is provided with moisture removal grooves 46, 48 which extend radially along and adjacent the leading edges 50 of the blades in a conventional manner, permitting moisture to be channelled radially away from the blades (by centrifugal forces) and to migrate to a stationary moisture removal groove 52 (see FIG. 2).

In this known arrangement, the width dimension W of the bucket shroud segments 22, 24 is not sufficient to cover the effective width dimension W' of the blades 12. This axial cut back in the cover width permits moisture travelling radially outwardly in grooves 46, 48 to escape via the moisture removal groove 52 without being blocked by the shroud or cover segments. As a result, however, this cut back in the width dimension W can significantly affect the bucket entrance design and vibration frequencies, and also eliminates cover edge sealing efficiency between the entrance edge 34 of the cover 18, and the stationary turbine housing 200 (see FIG. 2) which in turn reduces stage thermal efficiency. In addition, the axial cut back of the cover necessitates a redesign of the tenon and blade tip, including a reduction from the typical two tenon per blade arrangement to a one tenon per blade arrangement.

Figure 4:
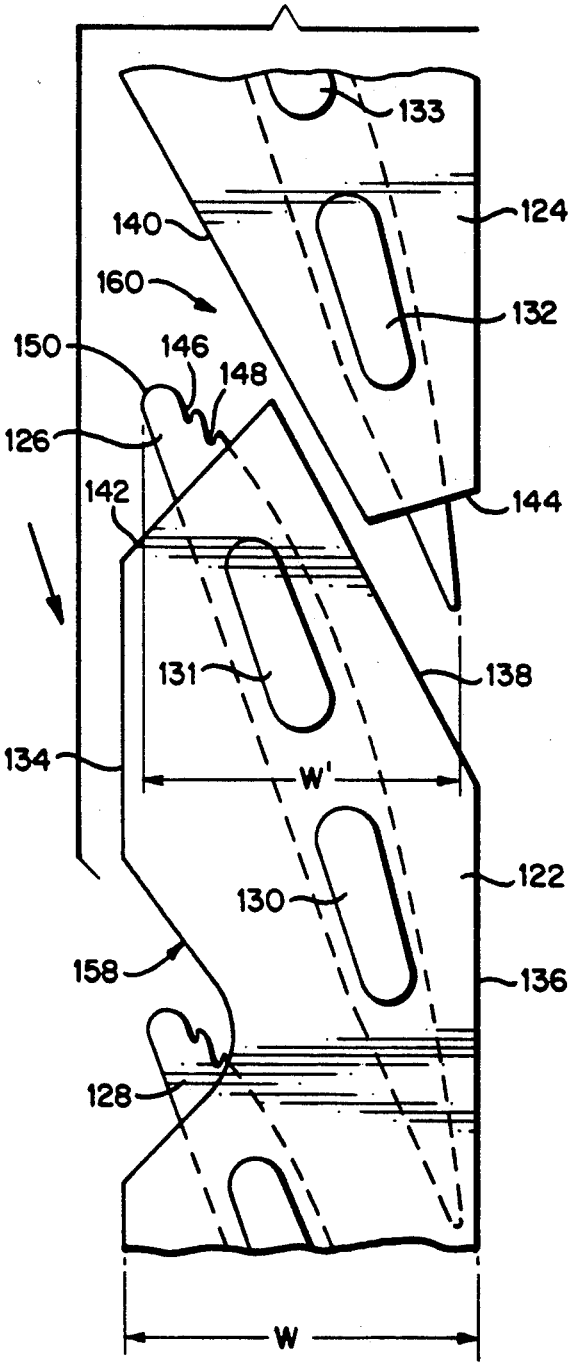
FIG. 4 is a partial radial view of a bucket tip and peened-on cover in accordance with an exemplary embodiment of this invention.

With reference now to FIG. 4, the bucket shroud or cover design in accordance with a first exemplary embodiment of the invention is illustrated.

Initially, it will be readily appreciated that the width dimension W of the tip cover segments 122, 124 is slightly greater than (or at least equal to) the effective width W' between the leading and trailing edges of the blades 126, 128 to improve effective tip sealing. In other words, the cover width dimension as used in known non-moisture removal covers may be retained. To insure effective moisture removal, each tip shroud segment 122, 124 is provided with a scalloped area 158 in the form of a rounded V-shaped notch which radially exposes the leading edge 150 and moisture removal grooves 146, 148 of the blades 126, 128. The single scalloped area 158 shown is located intermediate the ends of the segment 122, and similar scalloped areas are provided for each blade covered by the respective segment (in the event the segment covers more than 2 adjacent buckets), with the exception of the blades radially adjacent the ends of the segment. For the latter, the forward portion of transverse edge 140 is beveled or truncated at 142 in such a way that the leading edge 150 of the blade 126 is radially exposed. The surface 142 cooperates with a transverse edge 140 of the adjacent segment 124 to create a notch 160 generally similar to the scalloped area 158. This arrangement of scalloped areas 158 and notches 160 continues in a similar manner about the entire circumference of the cover.

It will be appreciated that the above tip shroud or cover design relates to a peened-on cover, where segments are provided with openings adapted to receive associated tenons 130, 131 or 132, 133 (the conventional two tenon per blade arrangement may be maintained) extending radially from the bucket tips, and that each segment couples a predetermined number or group of blades, for example, 4, but individual segments could also extend over 2, 3 or more than 4 blades. It will be appreciated that the number of scalloped areas 158 will depend on the number of blades connected by each segment, e.g., if four blades are covered by one segment, then three blades will be radially exposed by scalloped areas 158 while the leading blade will be radially exposed by a notch of the type shown at 160.

Figure 5:
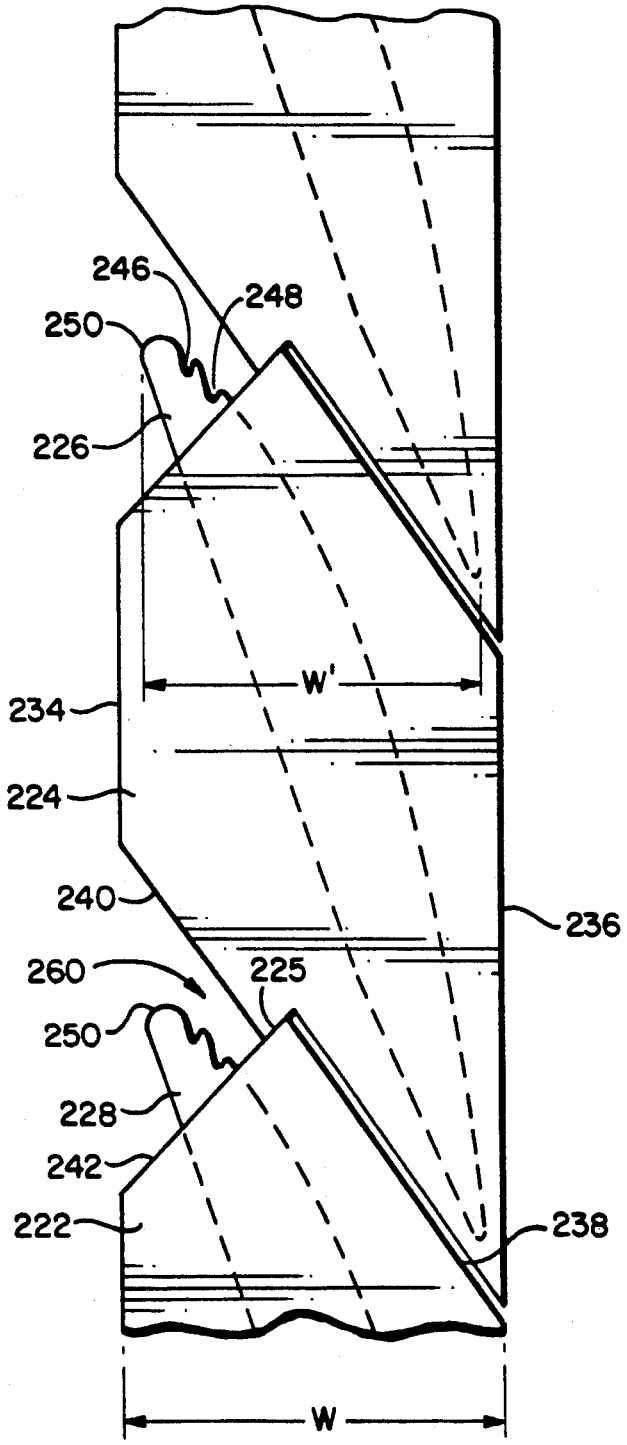
FIG. 5 is a partial radial view of a bucket tip and integral cover in accordance with an alternative embodiment of the invention.

In FIG. 5, the invention is applied to an integral cover assembly, where each bucket or blade 226, 228 is provided with a respective integral cover segment 224, 222.

As in the earlier described embodiment, the width dimension W is greater than width dimension W' to insure the desired entrance edge sealing. In this second exemplary embodiment, the transverse edge 240 of segment 224 is angularly stepped at 225 to interfit with transverse edge 238 of segment 222. The forward portion of transverse edge 238 of segment 222 is beveled or truncated at 242 to form, in cooperation with transverse edge 240 of the adjacent segment 224, a notch 260 which radially exposes the leading edge 250 and moisture removal grooves 246, 248 in the same manner as previously described. It will be noted that surface 242 abuts step 225 to form an interlock between adjacent segments 222, 224. This same arrangement is provided for each blade about the circumference of the bucket/-cover assembly.

The above described invention thus provides a new and unique cover design which permits moisture removal while at the same time maintaining good entrance edge sealing efficiency. This, in turn, permits utilization of the same bucket/cover design in turbines in both moisture removal and non-removal applications, thus effecting considerable cost savings without sacrificing turbine stage efficiency.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. In an axial flow steam turbine including a rotor; an annular row of radially extending blades carried by the rotor, each blade having a leading edge, a trailing edge and a radial tip, and at least one moisture removal groove extending radially along the blade adjacent the leading edge; and an annular cover assembly coupling the radial tips of the annular row of blades, the cover assembly having an annular entrance edge; the improvement comprising: the cover assembly having a width dimension at least substantially equal to an effective axial width dimension of said blades, and wherein a plurality of axially extending notches are formed in the annular entrance edge of the cover assembly, one notch provided for each blade, the notch radially exposing the leading edge and moisture removal groove of each such blade.

2. The steam turbine cover of claim 1 wherein said annular cover assembly comprises a plurality of segments, each segment coupled to the radial tips of a group of said annular row of blades.

3. The steam turbine cover of claim 1 wherein said annular cover assembly comprises a plurality of segments, one segment for each of said blades.

4. The steam turbine cover of claim 2 or 3 wherein adjacent segments have surfaces cooperating to form at least some of said notches.

5. The steam turbine cover of claim 2 wherein at least some of said notches are formed by scalloped areas between opposite circumferential end portions of each segment.

6. The steam turbine cover according to claim 2 wherein each segment is coupled to each radial tip by a pair of tenons.

7. The steam turbine cover according to claim 3 wherein each segment is integral with the corresponding blade.

8. The steam turbine cover according to claims 2 or 3 wherein each segment at least partially overlaps an adjacent segment in axial and circumferential directions.

9. The steam turbine cover according to claim 3 wherein each segment at least partially interlocks with an adjacent segment.

10. A steam turbine cover for an axial flow steam turbine including a rotor and an annular row of radially extending blades carried by the rotor, each blade having a leading edge and trailing edge, the cover comprising:

an annular strip including one or more curved sections attachable to radially outer edges of said blades, the annular strip having a width dimension sufficient to cover the leading and trailing edges of the annular row of blades, the annular strip having a forward sealing edge closest the leading edges of the rotor blades and a rearward edge closest the trailing edges of the rotor blades, the forward sealing edge including relieved areas at circumferentially spaced locations to radially expose the leading edges of each of the blades.

11. The steam turbine cover of claim 10 wherein each blade is provided with at least one moisture removal groove adjacent its leading edge.

12. The steam turbine cover of claim 10 wherein a curved section is provided for a group of blades, each group having a predetermined number of said blades.

13. The steam turbine cover of claim 10 wherein each curved section is fastened to each blade in a group.

14. The steam turbine cover of claim 10 wherein a curved section is provided for each blade.

15. The turbine cover of claim 13 wherein at least some of said relieved areas are formed by a notch formed between opposite circumferential ends of each curved section.

16. The turbine cover of claim 10 wherein at least some of said relieved areas are formed by cooperating surfaces provided at circumferentially edges of adjacent segments.

* * * * *